United States Patent [19]

Theis, Jr. et al.

[11] 4,060,336

[45] Nov. 29, 1977

[54] FLUID ENGINE

[75] Inventors: James V. Theis, Jr., Delray Beach, Fla.; John B. McCord, Evanston; Harry H. Holly, Olympia Fields, both of Ill.

[73] Assignee: Hollymatic Corporation, Park Forest, Ill.

[21] Appl. No.: 732,905

[22] Filed: Oct. 15, 1976

Related U.S. Application Data

[63] Continuation of Ser. No. 569,544, April 18, 1975, abandoned, which is a continuation of Ser. No. 353,456, April 23, 1973, abandoned.

[51] Int. Cl.[2] ..... F01B 1/18

[52] U.S. Cl. ..... 415/80; 415/503

[58] Field of Search ..... 415/80, 81, 82, 63, 415/120, 203, 206, 503; 416/186; 60/39.35

[56] References Cited

U.S. PATENT DOCUMENTS

| | | | |
|---|---|---|---|
| 3,200,588 | 8/1965 | Math | 60/39.35 |
| 3,282,560 | 11/1966 | Kleckner | 415/80 |
| 3,709,305 | 1/1973 | Morress | 415/503 |
| 3,748,054 | 7/1973 | Eskelli | 415/80 |
| 3,758,223 | 9/1973 | Eskelli | 415/80 |

*Primary Examiner*—C. J. Husar
*Assistant Examiner*—L. J. Casaregola
*Attorney, Agent, or Firm*—Wegner, Stellman, McCord, Wiles & Wood

[57] ABSTRACT

A pressurized gas engine with an axially rotatable rotor having aerodynamically smooth exterior and interior fluid flow surfaces and a central opening in one of a pair of end walls that define with a peripherally circular border wall a hollow interior. The rotor includes energy conversion means that convert fluid pressure energy into mechanical energy of rotation with the conversion means including a plurality of nozzles in and spaced around the border wall and exhausting rearwardly of the direction of rotation. The rotor is enclosed in a casing that is spaced from the rotor at the areas traversed by the nozzles a distance sufficient that the exhaust fluid within the casing does not serve as a drag or brake on the rotating rotor so that the engine attains high speeds in an efficient manner. The disclosure also includes the fact that the total area of the entrance opening means to the rotor is greater than the total area of the exit opening means with the preferred ratio being about 2 to 1.

6 Claims, 12 Drawing Figures

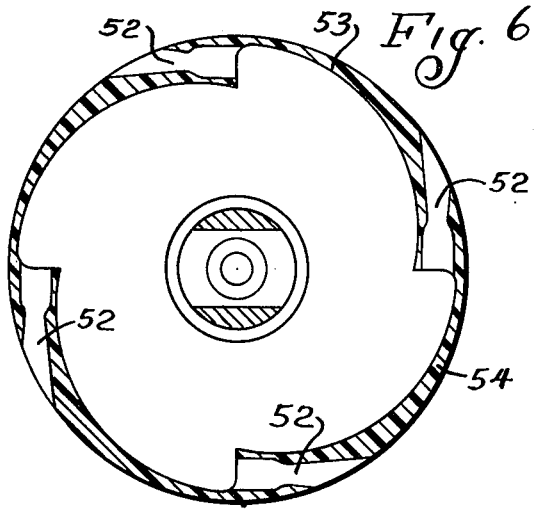
Fig. 6
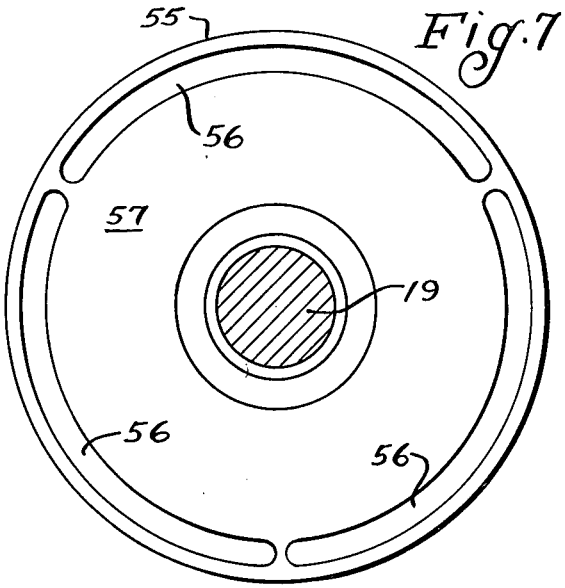
Fig. 7
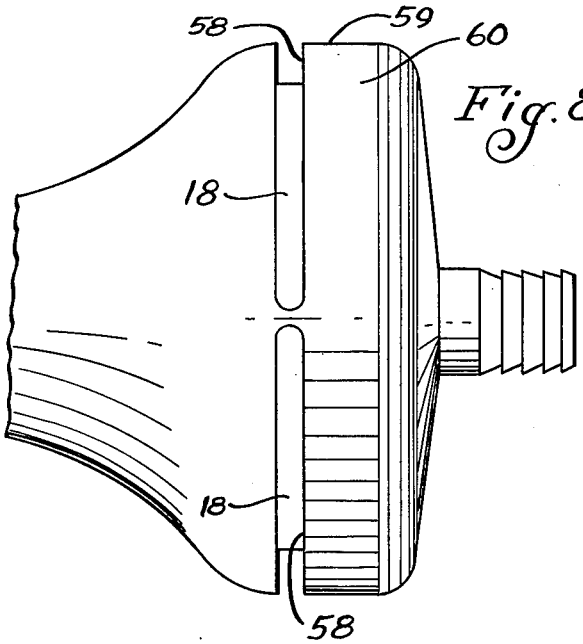
Fig. 8
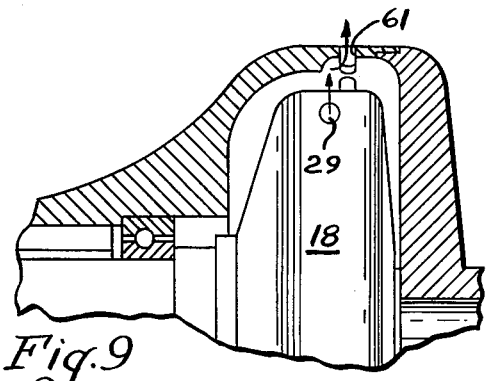
Fig. 9
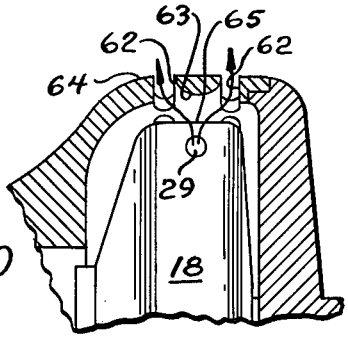
Fig. 10
Fig. 12
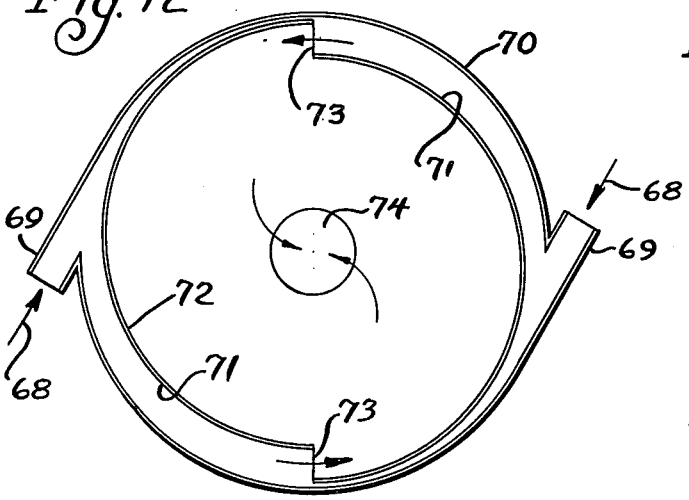
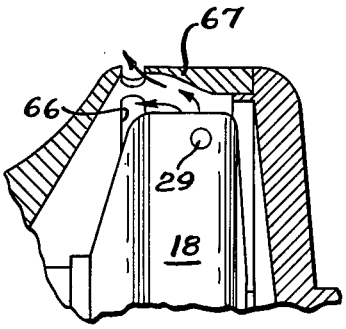
Fig. 11

FLUID ENGINE

This is a continuation of application Ser. No. 569,544 filed Apr. 18, 1975 (abandoned) which is a continuation of application Ser. No. 353,456 filed Apr. 23, 1973 (abandoned).

BACKGROUND OF THE INVENTION

One of the features of this invention is to provide a pressure fluid engine comprising a rotatable rotor, a casing in which the rotor is enclosed and peripherally spaced from the rotor a distance sufficient to prevent the exhaust fluid within the casing from operating as a fluid friction drag on the rotating rotor and with the fluid entrance to the rotor having an area greater than the fluid exit from the rotor so as to achieve efficient conversion of fluid pressure energy to mechanical rotational energy of the rotor by mechanical conversion energy means in the rotor.

DESCRIPTION OF THE PRIOR ART

The most pertinent references of which applicants are aware are U.S. Pat. Nos. 3,707,336 and 3,708,241. The present invention, however, has structural features and combinations as set out in the claims herein that are not disclosed in these prior patents or any other prior art of which applicants are aware.

BRIEF DESCRIPTION OF THE DRAWINGS

FIG. 6 is a view similar to FIG. 2 but illustrating a further embodiment.

FIG. 7 is a view similar to FIG. 3 but showing another embodiment.

FIG. 8 is a fragmentary side elevational view of the casing end of another embodiment of the engine of this invention.

FIGS. 9, 10 and 11 are fragmentary views partially in section and partially in side elevation illustrating further embodiments of fluid exhaust means from the casing for the fluid leaving the rotor.

FIG. 12 is a transverse sectional view through the rotor and casing of another embodiment of the invention.

Figures 1, 2, 3, 4, 5:
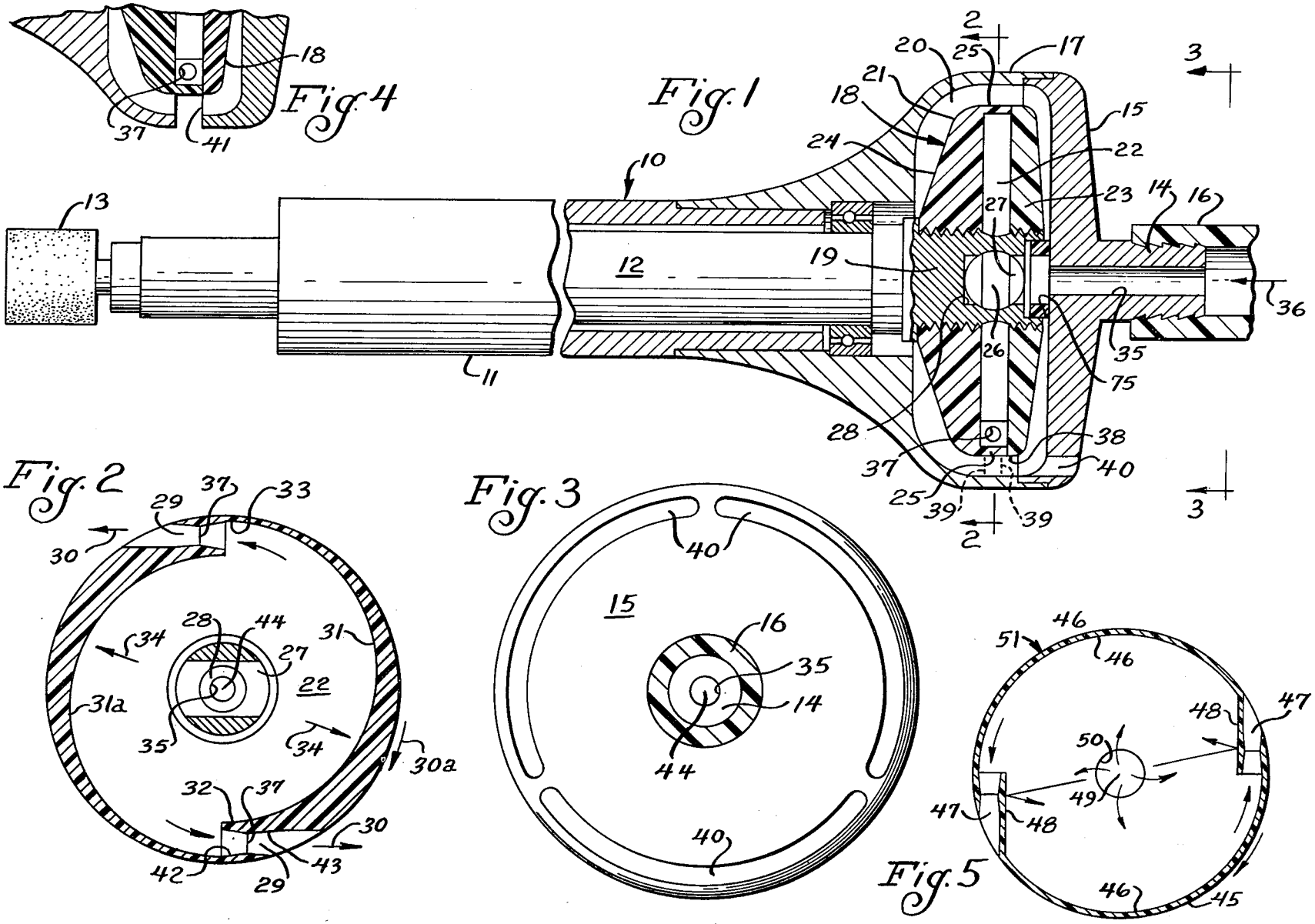
FIG. 1 is a partial longitudinal sectional view through a fluid engine embodying the invention.
FIG. 2 is a sectional view through the rotor only of FIG. 1 taken substantially along line 2—2 of FIG. 1.
FIG. 3 is a rear elevational view of the embodiment of FIG. 1 with a section through the fluid supply conduit as taken substantially along line 3—3 of FIG. 1.
FIG. 4 is a fragmentary sectional view similar to the lower portion of FIG. 1 but showing a further embodiment of the invention.
FIG. 5 is a sectional view through a rotor only of another embodiment of the invention.

The figures in the drawings are not necessarily to scale.

DESCRIPTION OF THE PREFERRED EMBODIMENTS

The engine of this invention converts fluid, and especially gas, pressure into rotary power in a highly efficient manner so that extremely high rotational speeds are achieved when no speed governor or other retarding device is used. The frictional drag of the fluid and rotor contact is minimized and the pressure energy of the fluid is converted in a highly efficient manner into rotational mechanical energy of the rotor to produce the high ungoverned speed as well as high torque.

In the embodiment disclosed in FIGS. 1–3 the engine 10 comprises a casing 11 having a rotatable shaft 12 with a forward end extending from the casing so as to drive a tool such as the schematically illustrated grinding wheel 13.

The casing 11 is provided on the rear end (which is the end opposite the grinder 13) with a fluid inlet 14 which is a rearward extension of a cap or cover 15. This fluid inlet or tube 14 is adapted to receive a flexible conduit or fluid supply hose 16 for the supply of pressure fluid to the engine.

The rear of the casing 11 at the cover 15 is enlarged as shown at 17 to provide a portion of the casing enclosing a rotor 18 mounted on the rear end 19 of the shaft 12.

The rotor 18 that is thusly located in the hollow space 20 within the casing 17 has an aerodynamically smooth exterior surface 21 so that friction drag between the fluid inside the casing 17 and the surface 21 is at a minimum. The rotor 18 also has an aerodynamically smooth hollow interior 22 bounded by spaced end walls 23 and 24 and a generally peripherally circular border wall 25 therebetween.

The rotor 18 has a central opening 26 defined by intersecting transverse 27 and axial 28 openings in the shaft end 19 on which the rotor is axially mounted.

The rotor 18 includes mechanical energy conversion means in the border wall 25 that includes a plurality of short nozzles 29 exhausting rearwardly of the direction of rotation as illustrated by the arrows 30 and **30*a***.

The border wall 25 also includes aerodynamically smooth peripheral surface areas 31 and **31*a* each leading to and directing fluid through a nozzle 29. In this embodiment the surfaces 31 and 31*a* are spiral in that the radius of each surface increases from an end 32 arcuately spaced from a nozzle to the end 33 adjacent the nozzle. The pressure of the fluid 34 flowing radially from the fluid inlet 35 against the surfaces 31 and 31*a* and then through the nozzles aids in converting the pressure energy of the incoming fluid 36 to rotational mechanical energy of the rotor as indicated by the rotation arrow 30*a***.

The casing 17 that encloses the rotor 18 is peripherally spaced therefrom so as to prevent the exhaust fluid within the space 20 in this embodiment from acting as a braking drag on the rotating rotor. Furthermore, in order to convert efficiently the pressure energy to rotational energy the total area of the entrance opening means which is here illustrated by the inlet 35 is greater than the total area of the fluid exit opening means from the rotor illustrated by the throat 37 areas of the pair of nozzles 29.

Under optimum conditions the transverse area of the entrance opening means embodied in the inlet 35 is at a ratio of approximately 2 to 1 to the exit opening means embodied in the total transverse throat 37 area. This ratio is optimum in that ratios greater than this do not produce a correspondingly increased benefit in operating efficiency and ratios less than this although usable do not achieve the optimum operation.

Each nozzle 29 preferably has a length that is not substantially greater than twice the diameter of the nozzle at its narrowest point which as illustrated in FIG. 2 is at the throat 37.

The periphery 38 of the rotor 18 which in the embodiment of FIG. 1 is the outer surface of the peripheral border wall 25 is spaced from the casing 17 a distance indicated by the length of the parallel broken lines 39 of FIG. 1 which multiplied by the diameter of the nozzle throat 37 is not less than the area of the nozzle throat 37. As shown in FIG. 1 the distance lines 39 are spaced apart a distance equal to the diameter of the throat 37. Therefore the product of the length of each distance 39 times the throat diameter is at least equal to the area of the throat and in the illustrated embodiment is somewhat greater. When these conditions are satisfied and vent means are provided for the escape of exhaust fluid, in which the vent means are considerably larger than the areas of the nozzle throats, the exhaust fluid has been found to provide very little interference such as frictional drag or eddy current drag to the rotating rotor. As a practical matter the spacing distance 39 is at least as great as the throat 37 diameter, or everage transverse dimension when the throat is not circular.

In order to vent exhaust fluid from the interior of the casing 17 and from around the rotating rotor 18 large area vent means 40 are provided. This vent means which in the first embodiment is in the form of elongated arcuate slots 40 adjacent the periphery 38 to the rotor in the region of the nozzles 37 exhausts the fluid rapidly and efficiently. As can be seen in FIG. 3 the vent means slots 40 are in the form of three elongated arcuate openings arranged end to end and thus each traversing slightly less than 120°. They are therefore arranged in a circular series on the outer edge of the rear cover 15.

In the embodiment of FIG. 1 the vents 40 are laterally spaced fromthe circular path described by the nozzles 29 during the rotation. Thus in this embodiment they are spaced outwardly of the path and to the rear. In the embodiment of FIG. 4, on the other hand, the arcuate vent means slots 41 which are otherwise similar to those illustrated at 40 are aligned with the path of rotation of the nozzles as they are located radially outwardly thereof.

The nozzles shown in the illustrated embodiments are free of fluid compressing flow restrictions and as shown each has an entrance 42, a throat 37 and a diverging exit portion 43 extending fromthe throat 37. The portion 43 is diverging in that it is of increasing diameter from the throat to the exit.

The spiral surfaces 31 and 31*a* of the first embodiment are sloped relative to the axis of rotation 44 of the rotor. Another embodiment of a sloped surface construction is illustrated in FIG. 5. In this embodiment the peripheral wall 45 has a generally circular inner surface 46 but the two nozzles 47 are in end wall portions whose inner surfaces 48 are straight and sloped relative to the axis 49 of rotation. The result is that fluid from the entrance 50 to the rotor 51 also strikes these surfaces 48 at an angle as illustrated.

In the embodiment of FIG. 6 there are provided four equally spaced nozzles 52 in the peripheral wall 53 of a rotor 54. The two nozzles of the first embodiment and the four nozzles of this embodiment are to illustrate the fact that the number of nozzles may be one or more, thus two, three, four or more as desired, and that there is preferably a plurality of nozzles primarily for dynamic balance.

In the embodiment of FIG. 7 the casing portion 55 is provided with a series of three circularly arranged adjacent vent slots 56 similar to the slots 40 of FIG. 3 but here the slots are located in the forward portion 57 of the casing 17 rather than the rear as is true of the slots 40.

In the embodiment of FIG. 8 the vent slots 58 are located at the periphery 59 of the casing 60 in which the rotor 18 is mounted.

FIGS. 9, 10 and 11 illustrate nozzle and vent embodiments whee the vents are out of alignment with the nozzles. Thus in the embodiment of FIG. 9 the vent slots 61 are elongated as shown in the previous embodiments and are offset from the nozzles 29 so that the exhausting fluid must follow generally a path containing two right angled turns before exhausting from the casing as shown at 61.

In the embodiment of FIG. 10 there are provided two pairs of vent slots 62 arranged in circular series on opposite sides of the path of rotation of the nozzles 29 so that the exhuast fluid is divided by the adjacent surface 63 of the casing 64. In this embodiment the surface area 63 is rounded so as to provide smooth flow into the two spaced paths illustrated by the bifurcated arrows 65.

In the embodiment of FIG. 11 the exhaust slots 66 are similar to those of FIG. 9 but here they are spaced forwardly of the rotor 18 in the casing 67. In all 3 embodiments of FIGS. 9, 10 and 11 the inner surface of the casing opposite the rotating nozzles 29 is sloped outwardly and toward the exhaust slots 61, 62 and 66 to aid in the rapid exhausting of the fluid.

In the embodiment of FIG. 12 the flow of fluid 68 is opposite in direction to that of the previous embodiments. Here the fluid flows into entrances 69 in the casing 70 and the sloped or inclined surfaces 71 are on the exterior of the peripheral wall 72. Each of these surfaces 71 leads to a nozzle 73 shown schematically as an opening which may be shaped similarly to the nozzles 29 or 52 of the previous embodiments and from the nozzles 73 to an axial exhaust 74 instead of the peripheral exhaust of the other embodiments.

The engine of this invention produces large torque and high speed with an excellent conversion of pressure energy to dynamic rotational energy. It provides a structure that prevents interference by the exhaust fluid with rotation of the rotor by providing a structure in which the exhaust fluid is rapidly conducted away from the surface of the rotor so that it does not produce a large degree of frictional drag. In order to further reduce this frictional drag the hollow interior 22 of the rotor and the exterior surfaces 21 are smooth and for this reason as well as rapid acceleration and deceleration, strength, low cost and other factors the rotor 18 is preferably constructed of a light weight but strong plastic such as nylon. In order to achieve rapid conversion of the pressure energy to rotational power the entrance area to the rotor and exit area from the rotor is a ratio greater than 1 to 1 with an optimum ratio being approximately 2 to 1. The nozzles as illustrated are short and free of pressure reducing constrictions and are preferably converging to a throat as illustrated at 37 and then diverging therefrom as illustrated at 43 in the first embodiment. It is therefore necessary to avoid converging only nozzles because of their interference with fluid flow and reduction of potential power.

The rotor 18 at the central opening 26 has projecting means embodied in the shaft end 19 that contains the large transverse 27 and axial 28 openings to provide unrestricted and smooth flow surfaces whereby fluid flow 36 into the hollow rotor 18 is turned smoothly from an axial direction or from right to left in FIG. 1 to radial as illustrated by the flow arrows 34 in FIG. 2.

In order to obtain maximum use of the fluid pressure the rotor at the fluid entrance is provided with a seal which may be of any kind desired and is illustrated by way of example by the annular seal 75, this being one of the seal embodiments disclosed in the above U.S. Pat. No. 3,708,241.

Having described our invention as related to the embodiments shown in the accompanying drawings, it is our intention that the invention be not limited by any of the details of description, unless otherwise specified, but rather be construed broadly within its spirit and scope as set out in the appended claims.

We claim:

1. A pressure gas turbine, comprising: a casing having a pressure gas entrance and a gas exit defining a gas fow path; a circular rotor in said casing rotatable about an axis of rotation and having a hollow interior section forming a part of said flow path and being substantially free of impediments tending to interfere with gas flow and to impart added rotational force to said gas during its flow through said rotor, said rotor having an arcuate surface means as a part of said hollow interior section defining a part of said gas flow path, said surface means being outwardly arcuately sloped relative to said axis and to said flow path; and a converging-diverging nozzle means for said gas aligned in series gas flow relationship with said arcuately sloped surface for converting gas pressure energy of said gas flowing into the turbine nozzle to gas velocity energy of said gas flowing from the nozzle, said nozzle having an internal passage with a converging entrance, a throat and a diverging exit, said gas flow path between said arcuate surface means of said hollow interior section and said nozzle being substantially free of flow restricting bends tending to impart turbulence to said gas, said nozzle having a lateral dimension adjacent to said arcuately sloped surface means that is essentially the same as the corresponding lateral dimension of said surface means for further promoting said essentially streamline gas flow.

2. The turbine of claim 1 wherein said casing is provided with vent openings adjacent to the periphery of said rotor and comprising said gas exit, the vent openings being laterally spaced in a direction substantially parallel to said axis of rotation from the circular path described by the nozzles during rotation of the rotor.

3. The turbine of claim 1 wherein the casing is provided with a peripheral border wall that is spaced outwardly of said rotor a distance such that the product of said distance multiplied by the diameter of the nozzle throat is at least as great as the transverse area of said nozzle throat.

4. The engine of claim 1 wherein there are provided a peripheral series of said arcuate surface means and each said arcuate surface means has an entrance side, an exhaust side and an impulse surface between said entrance and exhaust sides over which said pressure gas flows.

5. The engine of claim 4 wherein said nozzle passages are aligned with said impulse surfaces for essentially unrestricted gas flow therebetween.

6. The engine of claim 4 wherein each said arcuate impulse surface extends for about 180°.

* * * * *